US010314117B2

(12) United States Patent
Tonomura

(10) Patent No.: US 10,314,117 B2
(45) Date of Patent: Jun. 4, 2019

(54) INDUCTION HEATING SYSTEM

(71) Applicant: TOKUDEN CO., LTD., Kyoto-shi, Kyoto (JP)

(72) Inventor: Toru Tonomura, Otsu (JP)

(73) Assignee: TOKUDEN CO., LTD., Kyoto-shi (JP)

( * ) Notice: Subject to any disclaimer, the term of this patent is extended or adjusted under 35 U.S.C. 154(b) by 471 days.

(21) Appl. No.: 15/057,653

(22) Filed: Mar. 1, 2016

(65) Prior Publication Data

US 2016/0262212 A1 Sep. 8, 2016

(30) Foreign Application Priority Data

Mar. 2, 2015 (JP) ..... 2015-039874
Mar. 2, 2015 (JP) ..... 2015-039875

(51) Int. Cl.
*H05B 6/04* (2006.01)
*H05B 6/06* (2006.01)
(Continued)

(52) U.S. Cl.
CPC ..... *H05B 6/04* (2013.01); *H05B 6/06* (2013.01); *H05B 6/145* (2013.01); *H05B 6/36* (2013.01); *H05B 6/44* (2013.01)

(58) Field of Classification Search
CPC . H05B 6/04; H05B 6/06; H05B 6/145; H05B 6/36; H05B 6/44
(Continued)

(56) References Cited

U.S. PATENT DOCUMENTS 4,647,744 A * 3/1987 Kitano ..... H05B 6/145 219/619
2009/0010462 A1* 1/2009 Ekchian ..... H01M 2/1022 381/312
(Continued)

FOREIGN PATENT DOCUMENTS

DE 614190 C 6/1935
FR 2568149 A1 1/1986
(Continued)

OTHER PUBLICATIONS

European Patent Office, Extended European Search Report Issued in Application No. 16156995.9, dated Jul. 6, 2016, Germany, 8 pages.
(Continued)

*Primary Examiner* — Phuong T Nguyen
(74) *Attorney, Agent, or Firm* — Alleman Hall Creasman & Tuttle LLP

(57) ABSTRACT

The present invention intends to reduce unbalance among phase currents without use of a Scott connection transformer. The present invention is an induction heating system adapted to use a three-phase AC power source to operate a first induction heating apparatus including a first induction coil and a second induction heating apparatus including a second induction coil. In addition, the number of turns of the second induction coil is an even number. Also, one of a winding start point and a winding end point of the first induction coil is electrically connected to one phase of the three-phase AC power source, and the other one is electrically connected to a midpoint of the second induction coil. Further, the winding start point and the winding end point of the second induction coil are electrically connected to the remaining two phases of the three-phase AC power source.

13 Claims, 6 Drawing Sheets

(51) Int. Cl.
*H05B 6/14* (2006.01)
*H05B 6/36* (2006.01)
*H05B 6/44* (2006.01)

(58) Field of Classification Search
USPC ..... 219/618, 619, 652, 660–669, 672, 676
See application file for complete search history.

(56) References Cited

U.S. PATENT DOCUMENTS

| | | | | |
|---|---|---|---|---|
| 2010/0079232 | A1* | 4/2010 | Okawa | H01F 17/0006 336/200 |
| 2013/0140300 | A1* | 6/2013 | Cummings | H05B 6/02 219/672 |
| 2013/0265810 | A1* | 10/2013 | Kawato | H05H 1/46 363/131 |

FOREIGN PATENT DOCUMENTS

| | | | | |
|---|---|---|---|---|
| GB | 307044 | A | | 12/1929 |
| JP | H06267651 | A | | 9/1994 |
| JP | 2001297867 | A | * | 10/2001 |
| JP | 2001297867 | A | | 10/2001 |
| JP | 2003051379 | A | | 2/2003 |

OTHER PUBLICATIONS

Japanese Patent Office, Office Action and Search Report Issued in Application No. 2015039874, dated Dec. 27, 2018, 7 pages.
Japanese Patent Office, Office Action and Search Report Issued in Application No. 2015039875, dated Dec. 27, 2018, 7 pages.

* cited by examiner

INDUCTION HEATING SYSTEM

TECHNICAL FIELD

The present invention relates to an induction heating system using two induction heating apparatuses.

BACKGROUND ART

An induction coil of an induction heating apparatus is desirably supplied with a single-phase AC because when magnetic fluxes having different phases intersect with each other within the same magnetic circuit, the intersection causes a reduction in power factor and gives rise to non-uniformity in heat generation distribution.

On the other hand, a power source for the induction heating apparatus is typically a three-phase AC power source, and therefore in many cases, the single-phase AC is normally extracted from the three-phase AC.

Meanwhile, in a case of directly connecting induction coils of two induction heating apparatuses having the same specifications to U-V terminals and V-W terminals, the balance in phase currents among U-, V-, and W-phases becomes $1:\sqrt{3}:1$ causing an unbalance by a factor of 1.732. This violates the regulation "an equipment unbalanced factor of 30% or less calculated from a single-phase connected load as a general rule" in "the limitation of unbalanced load, and special machinery and tools" in the extension regulations for low voltage and high voltage reception (JEAC: Japan Electric Association Code).

In order to prevent this violation, as disclosed in Patent Literature 1, there is a method that provides a Scott connection transformer between a three-phase power source and induction coils, and extracts single-phase AC outputs for the two circuits from the three-phase AC.

However, the Scott connection transformer is required, resulting in significant disadvantages in cost and space.

CITATION LIST

Patent Literature

Patent Literature 1: JP-A2001-297867

SUMMARY OF INVENTION

Technical Problem

Therefore, the present invention is made in order to solve the above-described problem, and a main intended object thereof is to reduce the unbalance among phase currents without the use of a Scott connection transformer in a system adapted to operate two induction heating apparatuses using a three-phase AC power source.

Solution To Problem

That is, an induction heating system according to the present invention is an induction heating system adapted to use a three-phase AC power source to operate a first induction heating apparatus including a first induction coil and a second induction heating apparatus that has a magnetic circuit different from the first induction heating apparatus and includes a second induction coil, and a number of turns of at least the second induction coil is an even number. Also, one of the winding start point and winding end point of the first induction coil is electrically connected to one phase of the three-phase AC power source, and the other one is electrically connected to the midpoint of the second induction coil. Further, the winding start point and winding end point of the second induction coil are electrically connected to the remaining two phases of the three-phase AC power source.

Such a configuration makes it possible to reduce the unbalance among phase currents without the use of a Scott connection transformer because the first induction coil and the second induction coil, which are induction coils of the two induction heating apparatuses, are Scott connected. Details will be described later.

Desirably, a number of turns of each of the induction coils is an even number, and a connecting terminal is provided at the midpoint of each of the induction coils.

In this configuration, the first induction coil and the second induction coil can be configured to be the same and have compatibility with each other.

Desirably, the first induction heating apparatus and the second induction heating apparatus have the same electrical specifications; a number of layers of the induction coil of which the number of turns is an even number is an even number; and the winding start point, the winding end point, and the midpoint are positioned at axial direction end parts of the induction coil.

In this configuration, current of the first induction coil enters from the midpoint of the second induction coil, and is equally divided into two, and the divided currents respectively flow to the winding start point and the winding end point. The current flowing to the winding start point of the second induction coil and the current flowing to the winding end point are opposite in direction, and therefore generated magnetic fluxes are cancelled out and extinguished.

By setting the number of layers of at least the second induction coil to an even number, and positioning the winding start point, the winding end point, and the midpoint at the axial direction end parts of the induction coil, the magnetic fluxes are efficiently extinguished because the magnetic coupling between a winding part from the midpoint to the winding start point and a winding part from the midpoint to the winding end point is good.

Desirably, between one end side of each of the induction coils and the three-phase AC power source, a voltage control device adapted to control an applied voltage to each of the induction coils is provided.

This configuration makes it possible to independently control the outputs of the first and second induction heating apparatuses.

Even in the case where current flowing to the second induction coil is adjusted to zero by the voltage control device provided on the one end side of the second induction coil, current flowing through the first induction coil flows to the other end side of the second induction coil, and therefore the output of the second induction heating apparatus cannot be made zero. For this reason, by making a load capacitance of the second induction heating apparatus larger than a load capacitance of the first induction heating apparatus, the above-described phenomenon can be prevented from occurring, and the first induction heating apparatus and the second induction heating apparatus can be independently well controlled.

Desirably, the voltage control device is controlled such that the maximum applied voltage to the second induction coil is $\{2/(2\sqrt{3}-1)\}$ times a power source voltage resulting from subtraction of a voltage drop by the voltage control device at a maximum output time.

This configuration makes it possible to further reduce the unbalance among the phase currents. Details will be described later.

Desirably, a number of turns of each of the induction coils is 2N, where N is a natural number, and each of the winding start point and the winding end point of each of the induction coils is connected with an additional winding of which a number of turns is $(2/\sqrt{3}-1)N$. In addition, one of the winding start point and winding end point of the first induction coil is connected to the midpoint of the second induction coil, and the other one is connected to one phase of the three-phase AC power source. Further, the additional windings connected to both points of the second induction coil are connected to the remaining two phases of the three-phase AC power source, and thereby both points of the second induction coil are electrically connected to the remaining two phases of the three-phase AC power source.

This configuration makes it possible to make the phase currents equal to one another to eliminate the unbalance. Details will be described later.

Desirably, the number of turns of the second induction coil is 2N, where N is a natural number; and a number of turns of the first induction coil is $\sqrt{3}N$.

This configuration makes it possible to, when operating the two induction heating apparatuses having the same electrical specifications, make the phase currents equal to one another to eliminate the unbalance without need of a tap.

The three-phase AC power source is used for industrial equipment, and an object to be inductively heated is basically formed of thick metal because it is industrial equipment. For this reason, by setting a power source frequency of the three-phase AC power source to a commercial frequency of 50 Hz or 60 Hz, current penetration depth at the time of inductively heating the thick metal can be increased to efficiently heat the object.

A possible specific embodiment of the induction heating system is an induction-heated roll system. Specifically, it is possible that the first induction heating apparatus is a first induction-heated roll apparatus that includes, inside a rotatably supported first roll main body, a first induction-heated mechanism having the first induction coil; and the second induction heating apparatus is a second induction-heated roll apparatus that includes, inside a rotatably supported second roll main body, a second induction-heated mechanism having the second induction coil.

Advantageous Effects of Invention

According to the present invention configured as described, since the induction coils of the two induction heating apparatuses are Scott connected, the unbalance among the phase currents can be reduced without the use of a Scott connection transformer.

DESCRIPTION OF EMBODIMENTS

<First Embodiment >

Figure 1:
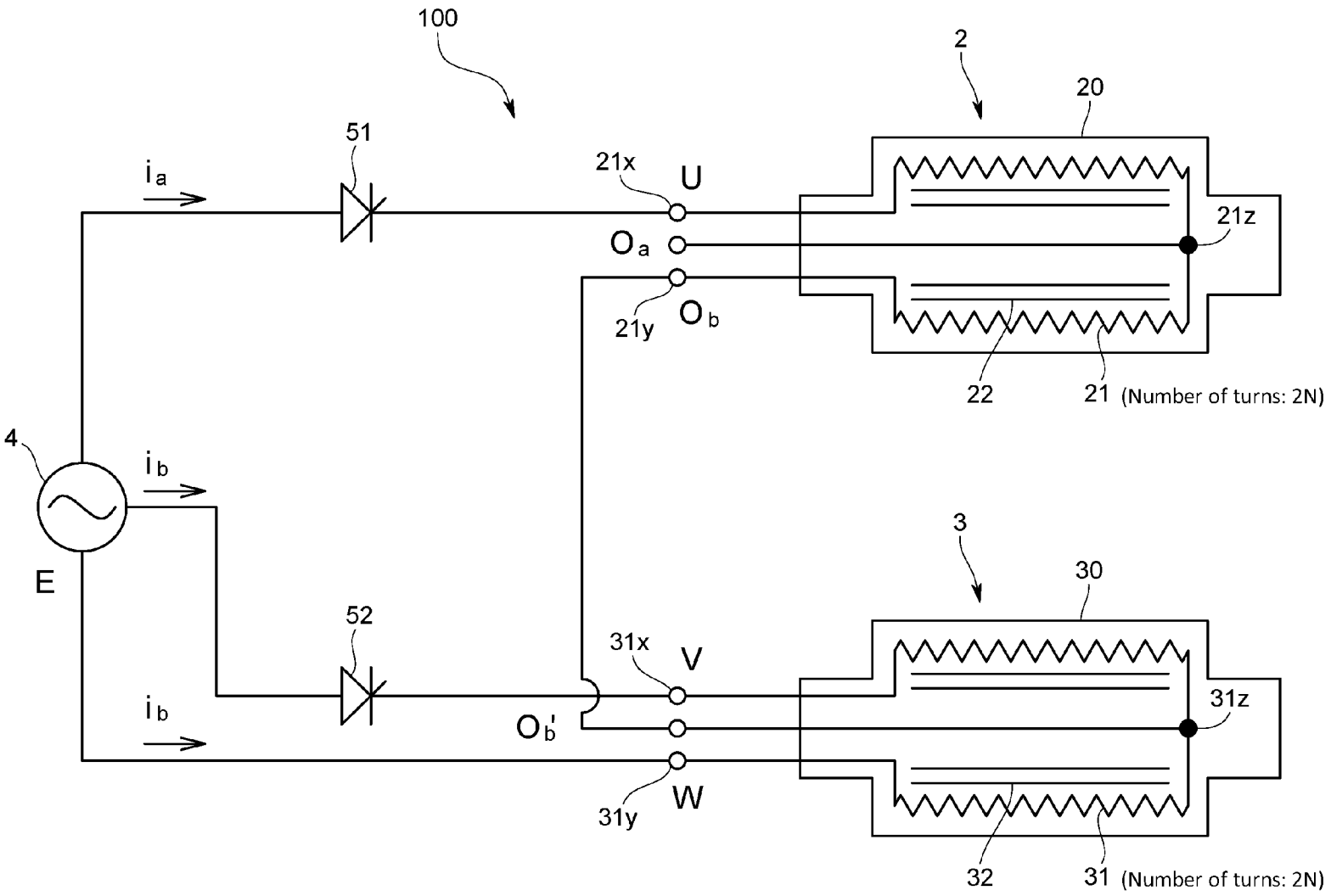
FIG. 1 is a diagram schematically illustrating the configuration of an induction-heated roll system according to a first embodiment.
Figure 2:
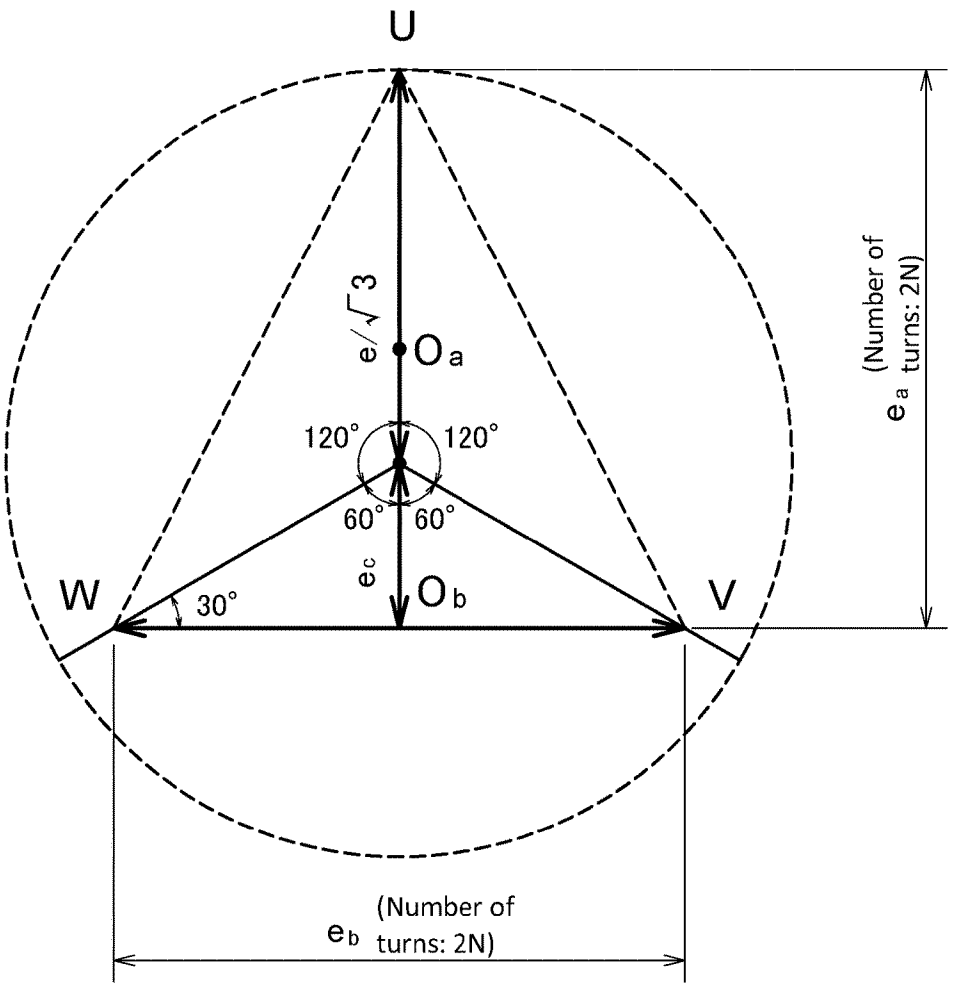
FIG. 2 is a vector diagram in one use example of the same embodiment.

In the following, an induction-heated roll system as a first embodiment of an induction heating system according to the present invention will be described with reference to drawings.

An induction-heated roll system 100 according to the first embodiment is one that operates two induction-heated roll apparatuses 2 and 3 using a single three-phase AC power source 4, and has the first induction-heated roll apparatus 2 including a first induction coil 21 and the second induction-heated roll apparatus 3 including a second induction coil 31. The first and second induction-heated toll apparatuses 2 and 3 have mutually different, independent magnetic circuits, respectively. The first induction-heated roll apparatus 2 includes, inside a rotatably supported first roll main body 20, a first induction -heated mechanism having the first induction coil 21, and the second induction-heated roll apparatus 3 is one that inside a rotatably supported second roll main body 30, includes a second induction-heated mechanism having the second induction coil 31.

Note that the respective induction-heated roll apparatuses 2 and 3 are configured to have the same electrical specifications, and the induction coils 21 and 31 are provided wound on iron cores 22 and 32 to configure the induction-heated mechanisms, respectively. Also, the power source frequency of the three-phase AC power source is a commercial frequency of 50 Hz or 60 Hz. This makes it possible to increase current penetration depths when inductively heating the roll main bodies as thick metal, and thereby the roll main bodies can be efficiently heated.

In addition, the first and second induction-heated roll apparatuses 2 and 3 and the three-phase AC power source 4 are Scott connected. Specifically, a winding start point 21*x* of the first induction coil 21 is electrically connected to the U-phase of the three-phase AC power source 4, and a winding end point 21*y* of the first induction coil 21 is electrically connected to a midpoint 31*z* of the second induction coil 31. Also, the winding start point 31*x* of the second induction coil 31 is electrically connected to the V-phase of the three-phase AC power source 4, and a winding end point 31*y* of the second induction coil 31 is electrically connected to the W-phase of the three-phase AC power source 4.

In the present embodiment, the both end points 21*x*, 21*y*, 31*x*, and 31*y* of the respective induction coils 21 and 31 are provided with connecting terminals, and the midpoints 21*z* and 31*z* of the respective induction coils 21 and 31 are provided with connecting terminals. Note that the connecting terminal provided at the midpoint 21*z* of the first induction coil 21 is not used in the present embodiment; however, the connecting terminal is provided in order to make the two induction coils 21 and 31 have the same specifications to achieve compatibility.

Also, the respective induction coils 21 and 31 are adapted to have the same even number of turns (2N (N is a natural number)). That is, the number of turns from the midpoint 21*z* or 31*z* to the winding start point 21*x* or 31*x* of each of the induction coils 21 and 31 is N, and the number of turns from the midpoint 21*z* or 31*z* to the winding end point 21*y* or 31*y* is also N.

In the present embodiment, the number of layers of each induction coil having the even number of turns is set to an even number. Specifically, in FIG. 1, each of the induction coils 21 and 31 is configured to have two layers. In doing so, the induction coils 21 and 31 are configured such that the winding start points 21*x* and 31*x* and the winding end points 21*y* and 31*y* are positioned on one axial direction end sides of the induction coils 21 and 31, and the midpoints 21*z* and 31*z* are positioned on the other axial direction end sides of the induction coils 21 and 31, respectively.

Further, between one end parts of the respective induction coils 21 and 31 and the three-phase AC power source 4, voltage control devices 51 and 52 adapted to control applied voltages to the respective induction coils 21 and 31 are provided. In the present embodiment, between the winding start point 21*x* of the first induction coil 21 and the three-phase AC power source 4 (U-phase), the first voltage control device 51 is provided, and between the winding start point 31*x* of the second induction coil 31 and the three-phase AC power source 4 (V-phase), the second voltage control device 52 is provided. Note that the voltage control devices 51 and 52 are respectively semiconductor control elements such as thyristors. The voltage control devices 51 and 52 are controlled by an unillustrated control part.

Next, currents flowing through each phase of the induction-heated roll system 100 configured as described will be described with reference to FIG. 1.

In the following, the power source voltage of the three-phase AC power source 4 is denoted by E, inter-terminal voltage resulting from subtracting a voltage drop caused by the control devices 51 or 52 is denoted by e, the terminals of the first induction coil 21 is denoted by U, $O_a$, and $O_b$, the capacitance of the first induction coil 21 is denoted by $P_a$, a current of the first induction coil 21 is denoted by $i_a$, the terminals of the second induction coil 31 is denoted by V, $O_b'$, and W, the capacitance of the second induction coil 31 is denoted by $P_b$, and a current of the second induction coil 31 is denoted by $i_b$. Also, calculations below are all absolute value calculations.

Given that the inter-terminal U-$O_b$ voltage of the first induction coil 21 is denoted by $e_a$, $e_a=\sqrt{3}e/2$.

The capacitance $P_a$ of the first induction coil 21 is $P_a=i_a\sqrt{3}e/2$.

The current $i_a$ of the first induction coil 21 is $i_a=2P_a/e\sqrt{3}$.

Since the inter-terminal V-W voltage of the second induction coil 31 is e, given that current with respect to the vector e is denoted by $i_b'$, the inter-terminal V-W voltage and the current are each $2/\sqrt{3}$ times that of the first induction coil 21 because the number of turns is 2N, which is the same as that of the first induction coil 21, and a coil impedance is also the same.

Accordingly, $i_b'=2i_a/\sqrt{3}$, and therefore the capacitance $P_b$ of the second induction coil 31 is $P_b=2i_ae/\sqrt{3}$.

The capacitance ratio between the first induction coil 21 and the second induction coil 31 is:

$$P_b/P_a=(2i_ae/\sqrt{3})/(i_a\sqrt{3}e/2)$$
$$=4/3.$$

The current $i_b$ of the second induction coil is:

$$i_b=\sqrt{\{(i_b')^2+(i_a/2)^2\}}$$

-continued $$=i_a\sqrt{(4/3+1/4)}$$
$$=i_a\sqrt{(19/12)}.$$

Accordingly, the current ratio among the respective phase currents is 1:1.258:1.258, and therefore the unbalance is reduced to a factor of 1.258.

Also, the current $i_a$ of the first induction coil 21 enters from the terminal $O_b'$ at the midpoint 31*z* of the second coil 31, and is equally divided into two, and the divided currents $i_a/2$ respectively flow to the terminals V and W. At this time, the current flowing to the terminal V and the current flowing to the terminal W are opposite in direction, and therefore generated magnetic fluxes are cancelled out and extinguished.

Since the second induction coil 31 is configured to have the even-numbered layers (two layers), and the winding start and end points 31*x* and 31*y*, and the midpoint 31*z* are positioned at the axial direction end parts of the second induction coil 31, respectively, the magnetic flux generated by the current flowing through a coil part between the terminals $O_b'$ and V, and the magnetic flux generated by the current flowing through a coil part between the terminals $O_b'$ and W are well coupled, and therefore the magnetic fluxes can be efficiently extinguished.

Also, as described above, since the magnetic flux generated by the second induction coil 31 is mostly cancelled out and extinguished, the heat generation power of the second induction coil 31 depends on only $i_b'$. Accordingly, only the second control device 52 can perform the power control of the second induction-heated roll apparatus 3.

Note that depending on the coupling state between the inter-terminal V-$O_b'$ coil part and the inter-terminal $O_b'$-W coil part, part of the magnetic fluxes remains, and the remaining magnetic fluxes affect the heat generation power. However, the induction-heated roll apparatus 3 is one that basically controls load temperature, and controls total power including the effect of the remaining magnetic fluxes, and therefore induction heating temperature can be controlled without any difficulty.

Further, even in the case of using the second voltage control device 52 to adjust the current $i_b'$ caused by the vector e to zero, the current $i_a$ flows to the terminal side (W-phase) not connected with the second voltage control device 52, and therefore the output of the second induction-heated roll apparatus 3 cannot be adjusted to zero. Accordingly, arranging the second induction-heated roll apparatus 3 on a side where the load capacitance is large prevents the output of the second induction-heated roll apparatus 3 from being adjusted to zero in a state where the current $i_a$ of the first induction-heated roll apparatus 2 flows, and therefore the first induction-heated roll apparatus 2 and the second induction-heated roll apparatus 3 can be independently well controlled.

Next, power source voltage resulting from subtracting a voltage drop caused by each voltage control device at the time of maximum output is denoted by e, and the maximum applied voltage applied between the terminals V and W of the second induction coil 31 by the second voltage control device 52 is denoted by $e_b$.

Given here $e_a=e/\sqrt{3}+e_c$, $e_c=e_a-e/\sqrt{3}$.

Also, since $e_c=e_b/2\sqrt{3}$, $e_b/2\sqrt{3}=e_a-e/\sqrt{3}$.

Accordingly, $e_b=2/\sqrt{3}(e_a-e/\sqrt{3})=2/\sqrt{3}e_a-2e$.

Calculating here a condition satisfying $e_a=e_b$ results in: $e_b=2/\sqrt{3}e_b-2e$ $(2\sqrt{3}-1)e_b=2e$ $e_b=2e/(2\sqrt{3}-1)$.

That is, by setting $e_b$ to $e_b=2e/(2\sqrt{3}-1)$, the maximum applied voltage $e_a$ applied to the first induction coil 21 also becomes the same, i.e., $e_a=2e/(2\sqrt{3}-1)$.

The maximum capacitance also becomes the same, i.e., $P_a=P_b=2ei_a/(2\sqrt{3}-1)$.

$$\text{Current } i_a = (2\sqrt{3}-1)P_a/2e$$

$$\begin{aligned}\text{Current } i_b &= \sqrt{\{i_a^2+(i_a/2)^2\}}\\ &= i_a\sqrt{5}/2\\ &= 1.118i_a\end{aligned}$$

Accordingly, the current ratio among the respective phase currents becomes 1:1.118:1.118, and therefore the unbalance is reduced to a factor of 1.118. That is, by adjusting the maximum applied voltage $e_b$ to the second induction coil 31 to a factor of $\{2/(2\sqrt{3}-1)\}$ with respect to the power source voltage e resulting from subtracting the voltage drop caused by the voltage control device 52 at the time of maximum output, the unbalance among the phase currents can be further reduced.

In addition, obtaining $i_b$ by substituting $i_a$ into the above expression for $i_b$ results in the following:

$$\begin{aligned}i_b &= i_a\sqrt{5}/2\\ &= \sqrt{5}(2\sqrt{3}-1)P_a/(2\times 2e)\\ &= (2\sqrt{15}-\sqrt{5})P_a/4e.\end{aligned}$$

<Effects of First Embodiment>

In the above-configured induction-heated roll system 100 that supplies power to the first induction coil 21 and the second induction coil 31 from the single three-phase AC power source 4, since the first induction coil 21 of the first induction-heated roll apparatus 2 and the second induction coil 31 of the induction-heated roll apparatus 3 are Scott connected, the unbalance among the phase currents can be reduced without the use of a Scott connection transformer.

<Second Embodiment >

Next, an induction-heated roll system as a second embodiment of the induction heating system according to the present invention will be described with reference to drawings.

The induction-heated roll system 100 according to the second embodiment is different from the first embodiment in coil configuration and Scott connection configuration.

The number of turns of each of a first induction coil 21 and a second induction coil 31 in the present embodiment is 2N (N is a natural number), and the winding start points 21*x* and 31*x* and winding end points 21*y* and 31*y* of the induction coils 21 and 31 are respectively connected with additional windings 23 and 33 each of which the number of turns is $(2/\sqrt{3}-1)N$. Note that the total number of turns of the first induction coil 21 and the additional windings 23, and the total number of turns of the second induction coil 31 and the additional windings 33 are both $2N+2\times(2/\sqrt{3}-1)N=N(2+4/\sqrt{3}-2)=4N/\sqrt{3}$.

In addition, the winding start point 21*x* of the first induction coil 21 is electrically connected to the V-phase of a three-phase AC power source 4, and the winding end point 21*y* of the first induction coil 21 is electrically connected to the midpoint 31*z* of the second induction coil 31. Also, the additional winding 33 connected to the winding start point 31*x* of the second induction coil 31 is electrically connected to the U-phase of the three-phase AC power source 4, and the additional winding 33 connected to the winding end point 31*y* of the second induction coil 31 is electrically connected to the W-phase of the three-phase AC power source 4.

Figure 3:
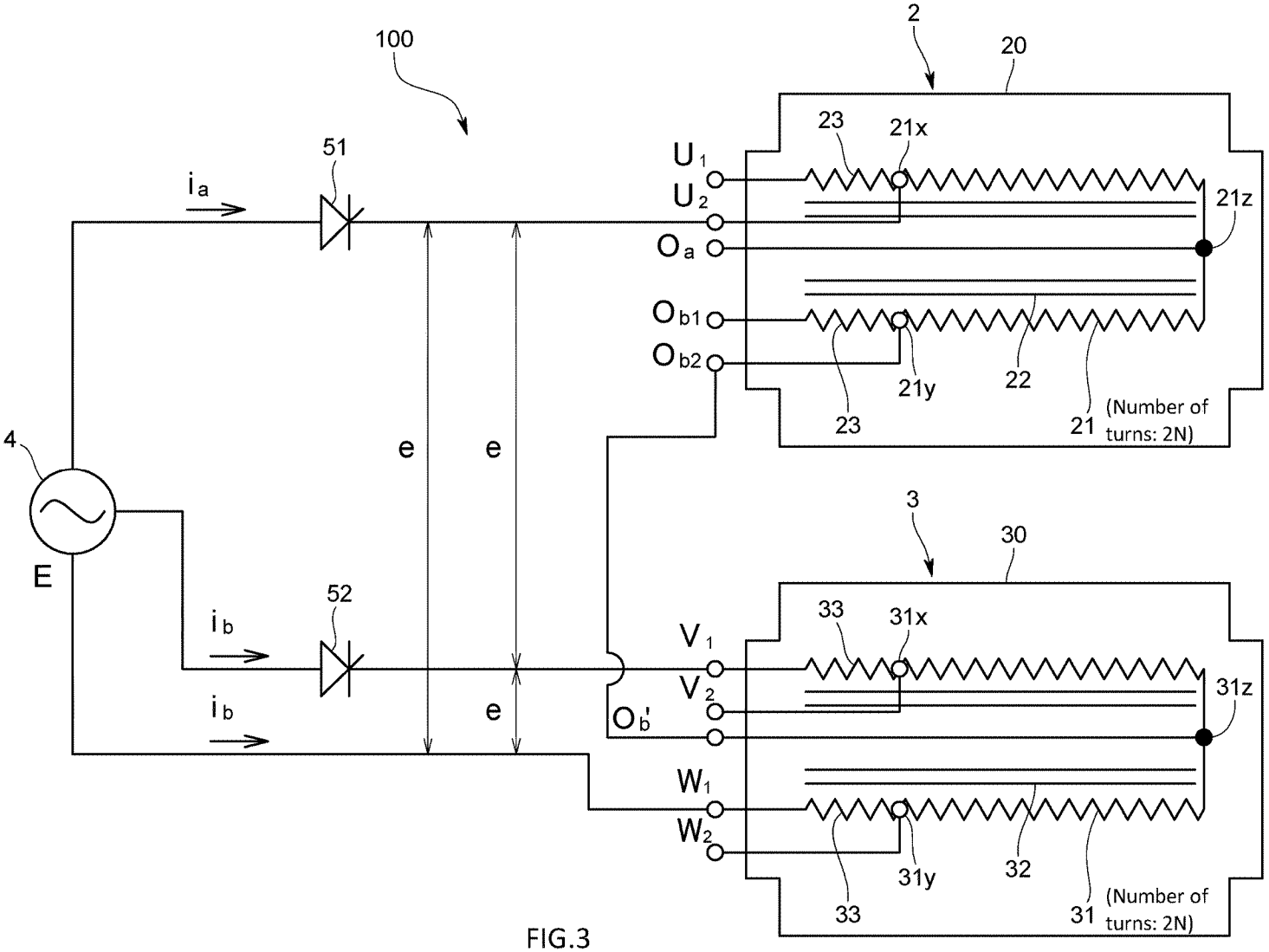
FIG. 3 is a diagram schematically illustrating the configuration of an induction-heated roll system according to a second embodiment.
Figure 4:
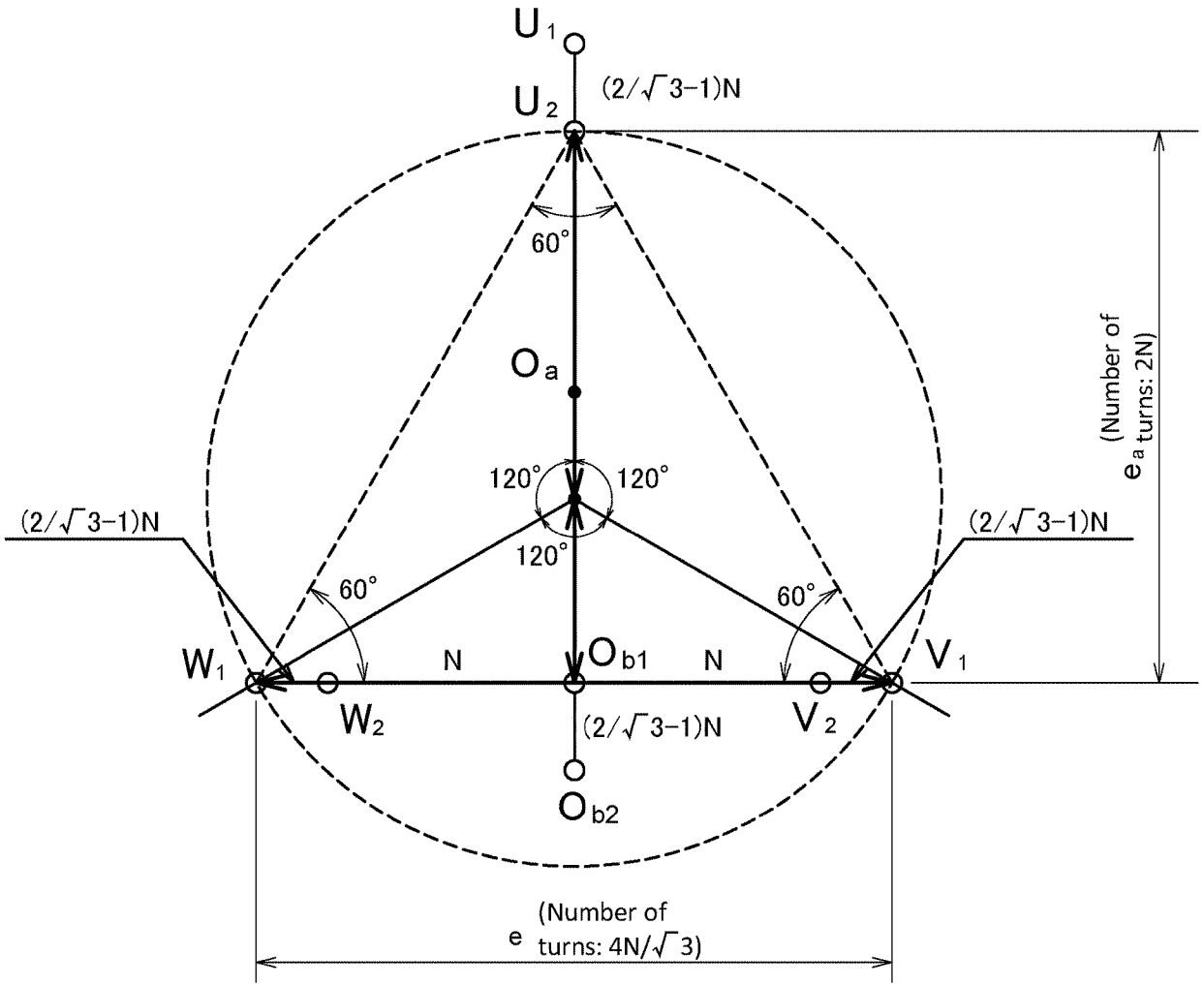
FIG. 4 is a vector diagram in the second embodiment.

Next, current flowing through each phase of the induction-heated roll system 100 configured as described will be described with reference to FIGS. 3 and 4.

Respective voltages, currents, and capacitances are as follows.

$e_a=e\sqrt{3}/2$ $i_a=P_a/(e\sqrt{3}/2)$ $P_a=i_ae\sqrt{3}/2$ $e_b=e$ $i_b'=P_b/e$ Given here $P_a=P_b$, $i_b'=i_a\sqrt{3}/2$, and $i_b=\sqrt{\{(i_a\sqrt{3}/2)^2+(i_a/2)^2\}}$ $=i_a$.

Accordingly, the first induction coil 21 and the second induction coil 31 have the same capacitance, and therefore the respective phase currents are all equal to $i_a$, making it possible to balance the induction-heated roll system 100.

<Effects of the Second Embodiment >

In the induction-heated roll system 100 configured as described, when operating the two induction-heated roll apparatuses 2 and 3 having the same electrical specifications, the phase currents can be made equal to one another to eliminate the unbalance without the need of a tap by adding the additional windings 23 an 33 to the induction coils 21 and 31 in the first embodiment, and making a Scott connection.

<Variations of the Present Invention >

Note that the present invention is not limited to any of the above-described embodiments.

In terms of the configuration of an induction coil, the first induction coil 21 and the second induction coil 31 may be differently configured.

Specifically, in the first embodiment, it is not necessary to provide the midpoint 21*z* of the first induction coil 21 with the connecting terminal. In addition, the number of turns of the first induction coil 21 is not required to be an even number.

Further, in the second embodiment, the additional windings 23 may be configured such that they are not connected to the winding start point 21*x* and winding end point 21*y* of the first induction coil 21, respectively.

Figure 5:
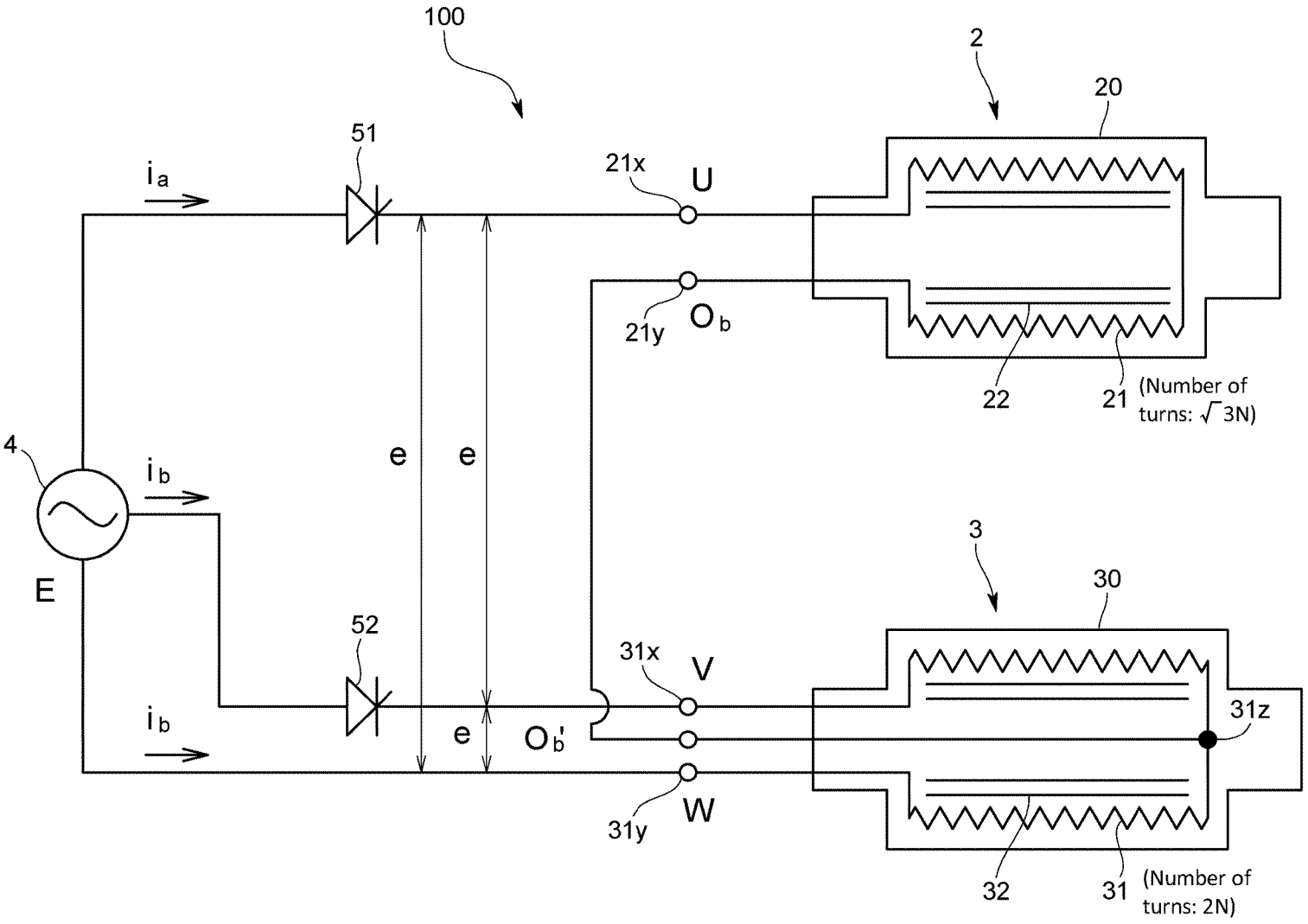
FIG. 5 is a diagram schematically illustrating the configuration of an induction-heated roll system according to a variation.
Figure 6:
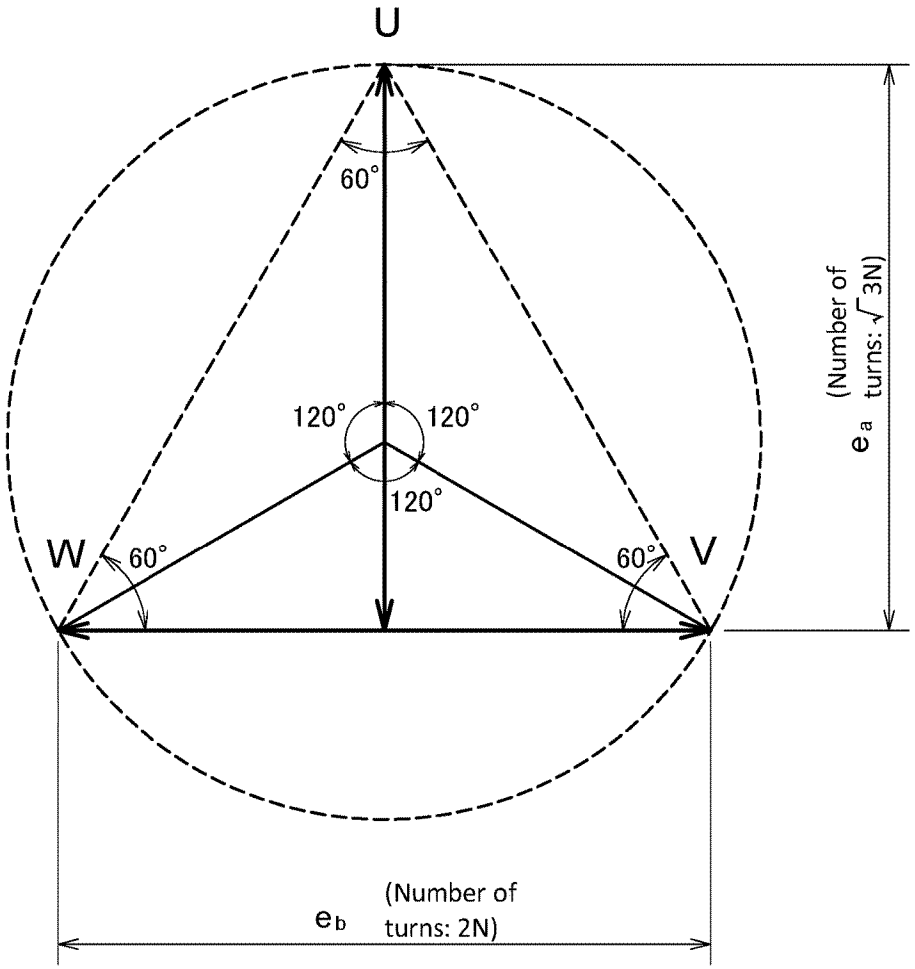
FIG. 6 is a vector diagram in the variation.

Further, as illustrated in FIGS. 5 and 6, the induction coils may be configured such that the number of turns of the second induction coil 31 is set to 2N (N is a natural number) and the number of turns of the first induction coil 21 is set to $\sqrt{3}N$. This case is electrically the same as the second embodiment, and when operating the two induction-heated roll apparatuses 2 and 3 having the same electrical specifications, the phase currents can be made equal to one another to eliminate the unbalance without the need of a tap.

In addition, in any of the above-described embodiments, each of the induction heating apparatuses is the induction-heated roll apparatus, but may be another induction heating apparatus. In each of the induction heating apparatuses, the induction coil is provided wound on the iron core. Also, as each of the induction heating apparatuses, for example, a fluid heating apparatus that inductively heats a conductive tube as a secondary coil wound on an iron core with an induction coil as a primary coil, and heats fluid flowing through the conductive tube is possible. In this case, it may be possible to configure a superheated steam generating system in which a first induction heating apparatus heats water to generate saturated steam, and a second induction heating apparatus heats the saturated steam generated by the first induction heating apparatus to generate superheated steam. In addition, the power source frequency of a three-phase AC power source is a commercial frequency of 50 Hz or 60 Hz. This makes it possible to increase the current penetration depth at the time of inductively heating thick metal such as the conductive tube to efficiently heat an object.

Furthermore, the present invention is not limited to any of the above-described embodiments, but can be variously modified without departing from the scope thereof.

REFERENCE CHARACTER LIST

100 Induction-heated roll system (Induction heating system)

2 First induction-heated roll apparatus (first induction heating apparatus)

21 First induction coil

21*x* Winding start point of first induction coil

21*y* Winding end point of first induction coil

3 Second induction-heated roll apparatus (second induction heating apparatus)

31 Second induction coil

31*x* Winding start point of second induction coil

31*y* Winding end point of second induction coil

31*z* Midpoint of second induction coil

4 Three-phase AC power source

51 First voltage control device

52 Second voltage control device

The invention claimed is:

1. An induction heating system adapted to use a three-phase AC power source, wherein the induction heating system comprises:

a first induction heating apparatus including a first induction coil; and a second induction heating apparatus that has a magnetic circuit different from the first induction heating apparatus and incudes a second induction coil, wherein:

a number of turns of at least the second induction coil is an even number;

one of a winding start point and a winding end point of the first induction coil is electrically connected to one phase of the three-phase AC power source, and the other one is electrically connected to a midpoint of the second induction coil, such that the first induction coil is directly electrically connected to the second induction coil; and a winding start point and a winding end point of the second induction coil are electrically connected to the remaining two phases of the three-phase AC power source.

2. The induction heating system according to claim 1, wherein:

the first induction heating apparatus and the second induction heating apparatus have a same electrical specification;

a number of turns of each of the induction coils is an even number; and a connecting terminal is provided at a midpoint of each of the induction coils.

3. The induction heating system according to claim 1, wherein:

a number of layers of the induction coil of which the number of turns is an even number is an even number; and the winding start point, the winding end point, and the midpoint are positioned at axial direction end parts of the induction coil.

4. The induction heating system according to claim 1, wherein a load capacitance of the second induction heating apparatus is larger than a load capacitance of the first induction heating apparatus.

5. The induction heating system according to claim 1, wherein between one end side of each of the induction coils and the three-phase AC power source, a voltage control device adapted to control an applied voltage to each of the induction coils is provided.

6. The induction heating system according to claim 5, wherein the voltage control device is controlled such that a maximum applied voltage to the second induction coil is $\{2/(2\sqrt{3}-1)\}$ times a power source voltage resulting from subtraction of a voltage drop by the voltage control device at a maximum output time.

7. The induction heating system according to claim 1, wherein:

a number of turns of each of the induction coils is 2N, where N is a natural number;

each of the winding start point and the winding end point of each of the induction coils is connected with an additional winding of which a number of turns is $(2/\sqrt{3}-1)N$;

one of the winding start point and the winding end point of the first induction coil is connected to the midpoint of the second induction coil, and the other one is connected to one phase of the three-phase AC power source; and the additional windings connected to both points of the second induction coil are connected to the remaining two phases of the three-phase AC power source, and thereby both points of the second induction coil are electrically connected to the remaining two phases of the three-phase AC power source.

8. The induction heating system according to claim 1, wherein:

the number of turns of the second induction coil is 2N, where N is a natural number; and a number of turns of the first induction coil is $\sqrt{3}N$.

9. The induction heating system according to claim 8, wherein:

a number of layers of the induction coil of which the number of turns is an even number is an even number; and the winding start point, the winding end point, and the midpoint are positioned at axial direction end parts of the induction coil.

10. The induction heating system according to claim 8, wherein a load capacitance of the second induction heating apparatus is larger than a load capacitance of the first induction heating apparatus.

11. The induction heating system according to claim 8, wherein between one end side of each of the induction coils and the three-phase AC power source, a voltage control device adapted to control an applied voltage to that induction coil is provided.

12. The induction heating system according to claim 1, wherein a power source frequency of the three-phase AC power source is 50 Hz or 60 Hz.

13. The induction heating system according to claim 1, wherein:

the first induction heating apparatus is a first induction-heated roll apparatus that includes, inside a rotatably supported first roll main body, a first induction-heated mechanism having the first induction coil; and the second induction heating apparatus is a second induction-heated roll apparatus that includes, inside a rotatably supported second roll main body, a second induction-heated mechanism having the second induction coil.

* * * * *